US011623255B2

(12) United States Patent
Duffus et al.

(10) Patent No.: US 11,623,255 B2
(45) Date of Patent: Apr. 11, 2023

(54) DEVICE FOR UNCLOGGING PUMPS AND PIPES

(71) Applicants: Travis Duffus, Coral Springs, FL (US); Gary Morrison, Tamarac, FL (US)

(72) Inventors: Travis Duffus, Coral Springs, FL (US); Gary Morrison, Tamarac, FL (US)

( * ) Notice: Subject to any disclaimer, the term of this patent is extended or adjusted under 35 U.S.C. 154(b) by 0 days.

(21) Appl. No.: 17/505,830

(22) Filed: Oct. 20, 2021

(65) Prior Publication Data

US 2022/0161300 A1 May 26, 2022

Related U.S. Application Data

(60) Provisional application No. 63/116,322, filed on Nov. 20, 2020.

(51) Int. Cl.
*B08B 9/043* (2006.01)
*E03F 9/00* (2006.01)
*E03C 1/30* (2006.01)

(52) U.S. Cl.
CPC ..... *B08B 9/0436* (2013.01); *E03C 1/30* (2013.01); *E03F 9/002* (2013.01); *B08B 2209/04* (2013.01)

(58) Field of Classification Search
CPC ..... E03C 1/30; E01H 2001/1293
See application file for complete search history.

(56) References Cited

U.S. PATENT DOCUMENTS 390,210 A * 10/1888 Crowley ..... E03F 9/002 15/104.31
3,576,342 A * 4/1971 Page ..... E01H 1/12 294/50.8
7,625,025 B1 * 12/2009 Zahedi ..... E01H 1/1206 294/1.3
10,370,809 B1 * 8/2019 Samen ..... A01K 27/006
2011/0197825 A1 * 8/2011 Jan ..... E01H 1/1206 119/795

* cited by examiner

*Primary Examiner* — Natasha N Campbell
(74) *Attorney, Agent, or Firm* — Brennan, Manna & Diamond, LLC

(57) ABSTRACT

The present invention relates generally to the field of pump cleaning and unclogging. More specifically, the present invention relates to a tool which allows a user to unclog and remove rags, cloth materials, debris, or other obstructions from submersible and master-station pumps. Further, the invention can be used either as a hand tool or as an attachment to a crane or other machine for power assisted pulling, unclogging, and removal of rags, cloth materials, debris, and other obstructions.

13 Claims, 5 Drawing Sheets

DEVICE FOR UNCLOGGING PUMPS AND PIPES

CROSS-REFERENCE TO RELATED APPLICATION

The present application claims priority to, and the benefit of, U.S. Provisional Application No. 63/116,322, which was filed on Nov. 20, 2020 and is incorporated herein by reference in its entirety.

FIELD OF INVENTION

The present invention relates generally to the field of pump cleaning and unclogging. More specifically, the present invention relates to a tool which allows a user to unclog, extract, and remove rags, cloth materials, debris and other obstructions from submersible and master-station water pumps. Further, the invention can be used either as a hand tool or as an attachment to a crane or other device for power-assisted extraction and removal of rags, cloth materials, debris and other obstructions. Further, the invention comprises a rod having external threads along a majority of its length, and steel hook ends (i.e. working end) used to grasp or snag rags, cloth materials, debris or other obstructions and remove them from the water pump. Further, the invention comprises a sleeve with internal threads that are configured to matingly engage with the external threads of the rod. To be described in more detail hereinafter, rotation of the sleeve moves the sleeve upward and downward along the rod length, thereby selectively constricting or expanding the movements of the hook ends. Moving the hook ends from a partially constrained position to a fully constrained position allows the device to grab and snag rags, cloth materials, debris or other obstructions for extraction and removal. Accordingly, the present disclosure makes specific reference thereto. Nonetheless, it is to be appreciated that aspects of the present invention are also equally applicable to other like applications, devices, and methods of manufacture.

BACKGROUND OF THE INVENTION

Water pumps, including but not limited to submersible and master-station water pumps, are susceptible to clogging by rags, cloth materials, debris, and other obstructions. It can be very difficult and time-consuming to unclog water pumps clogged with cloth and other materials using existing methods and tools such as pliers, screwdrivers, and the like. Cloth materials are particularly troublesome due to the strength and anti-tearing characteristics of the material. Cloth materials must be extracted in order to clear the obstruction. Attempting to unclog water pumps by hand can be dangerous if other debris is present inside the pipe system. Being able to extract an obstruction and unclog a water pump is an important and necessary factor in the proper operation and maintenance of the pumps including, but not limited to, in wastewater and other treatment facilities.

Therefore, there exists a long felt need in the art for a device that enables a user to easily and conveniently unclog, extract, and remove rags, cloth materials, debris, and other obstructions from submersible and master-station water pumps. There is also a long felt need in the art for a device that could easily be attached to an extension bar, crane, or other machine for power-assisted extraction in order to unclog and remove rags, cloth materials, debris and other obstructions from a water pump. Additionally, there is a long felt need for a device that is relatively inexpensive to manufacture and effective to use for unclogging and removal of rags, cloth materials, debris and other obstructions from submersible and master-station water pumps. Finally, there is a long felt need for a safe device that keeps a user's hands at a position away from the water pump opening while unclogging and removing rags, cloth materials, debris and other obstructions from submersible and master-station water pumps.

The subject matter disclosed and claimed herein, in one embodiment thereof, comprises a water pump unclogging device that allows a user to snag, pull, and extract rags, cloth materials, and other debris from water pumps. The device may be in the form of a threaded, rod-like body featuring a plurality of circumferentially-spaced steel hooks extending from one end of the rod. The device further comprises an internally-threaded sleeve that can be matingly engaged over the rod body via the respective threadings. The device is configured such that threading the sleeve toward the working hook end constricts or tightens a circumferential range of motion of the plurality of hooks. Further constriction of the range of motion of the plurality of hooks effectively snags and holds the obstructing material to the hook ends, whereby the material can then be pulled from the pump. The device can also be attached at another end distal to the working hook end to a crane or other machine using a large hook and chain system.

In this manner, the water pump unclogging device of the present invention accomplishes all of the forgoing objectives, and provides a relatively easy to use, convenient, inexpensive and safe method for the unclogging of and removal of rags, cloth materials, debris and other obstructions from submersible and master-station water pumps by the user. The water pump unclogging device of the present invention also includes a hook and chain to allow the user to attach the device to a crane or other machine for power assisted pulling and removal of rags, cloth materials, debris, and other obstructions.

SUMMARY

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a water pump unclogging device which allows a user to unclog and remove rags, cloth materials, debris and other obstructions from submersible and master-station water pumps. In one potential embodiment, the water pump unclogging device comprises a threaded, rod-like body featuring a plurality of circumferentially-spaced steel hooks extending from one end of the rod. The device further comprises an internally-threaded sleeve that can be matingly engaged over the rod body via the respective threadings. The device is configured such that threading of the sleeve toward the working hook end constricts or tightens a circumferential range of motion of the plurality of hooks. Further constriction of the range of motion of the plurality of hooks effectively snags and holds the obstructing material to the hook ends, whereby the material can then be pulled from the pump.

Further, the water pump unclogging device maintains a fixed circumferential opening after the hooks are selectively and fully constrained to permit the device to retain its hold on the obstruction for effective removal of same from a water pump. Further, the water pump unclogging device can be used either as a hand tool or as an attachment to a crane or other device for power-assisted pulling and removal of rags, cloth materials, debris and other obstructions. Further, the water pump unclogging device features a plurality of metal hook ends used to snag, hold, and/or grasp rags, cloth materials, debris or other obstructions and remove them from the water pump. Additional embodiments of the water pump unclogging device may further be comprised of different materials to manufacture the component parts.

The subject matter disclosed and claimed herein, in another embodiment thereof, comprises a method of extracting obstructing materials from a pump. The method comprises: providing an externally-threaded rod including a plurality of recessed channels circumferentially spaced about a first end of the rod; forming a plurality of hooks wherein each hook includes a pivot end, a shank section, a bend section, a throat section and a point end; the throat section of each hook is generally orthogonal to the shank section; matingly engaging an internally-threaded sleeve about the rod wherein the internal threads of the sleeve are sized for mating engagement with the external threads of the rod; inserting each pivot end and shank section of each hook into one of the recessed channels; rotating the sleeve from a first position to a second position along the rod; the first position partially constrains the plurality of hooks about the rod and the point ends of the plurality of hooks define a first circumference; the second position fully constrains the plurality of hooks about the rod completely within the recessed channels; and the point ends of the plurality of hooks define a second circumference for grasping obstructing material in the pump; and, the second circumference is smaller than the first circumference.

The water pump unclogging device of the present invention is particularly advantageous, due to the extension of the plurality of hook ends, because it enables users to better remove rags, cloth materials, debris and other obstructions from water pumps without the need to place the user's hands in or near the opening of the water pump.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided pictures, which show different views of the invention, and in which.

DETAILED DESCRIPTION

Figure 1A:
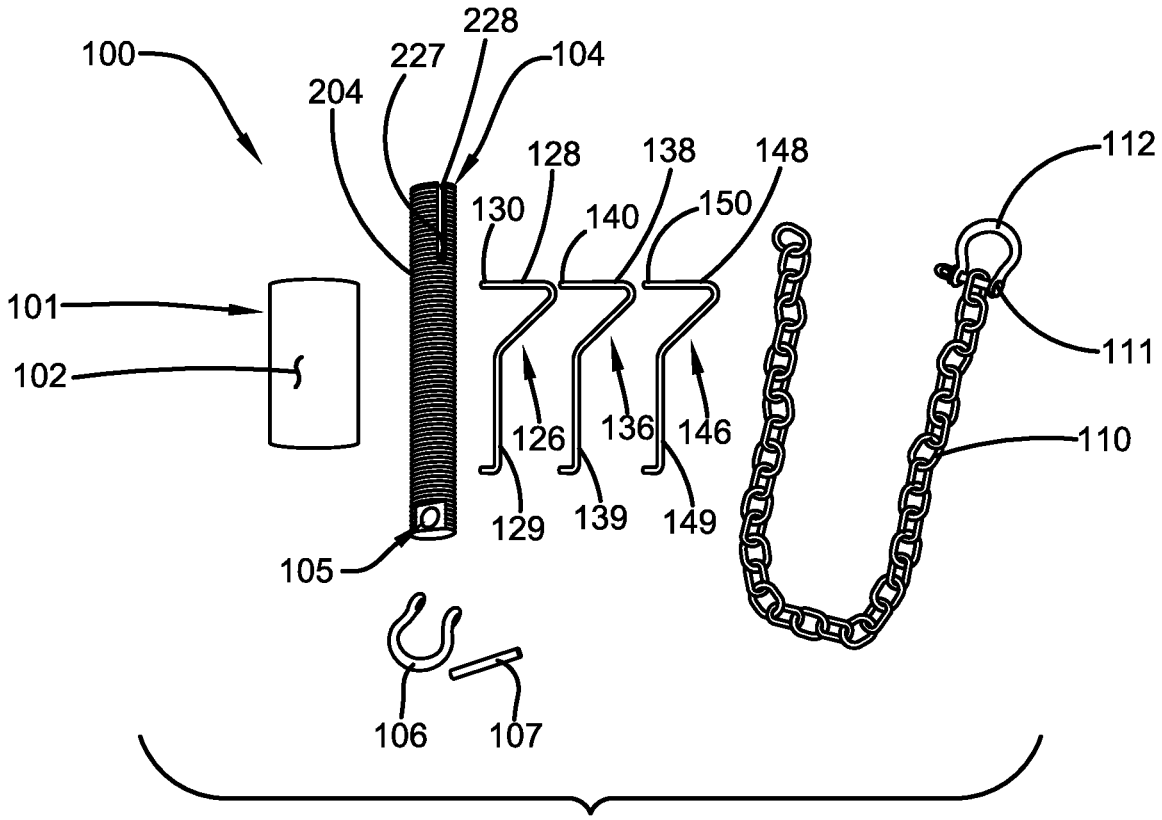
FIG. 1A illustrates a perspective view of the disassembled component parts of one potential embodiment of the water pump unclogging device of the present invention, laid next to one another in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there is a long felt need in the art of water pump and pipe maintenance and operation for a device that enables a user to easily and conveniently grasp and extract rags, cloth materials, debris and other obstructions from submersible and master-station water pumps. There is also a long felt need in the art for a device that can easily be attached to a crane or other device for power-assisted pulling and removal of rags, cloth materials, debris and other obstructions from a water pump. Additionally, there is a long felt need for a device that is relatively inexpensive to manufacture and effective to use for the unclogging and removal of rags, cloth materials, debris and other obstructions from submersible and master-station water pumps. Finally, there is a long felt need for a safe device that keeps a user's hands at a distance and away from the water pump opening while grasping, pulling and removing the obstruction.

Referring initially to the drawings, FIG. 1A illustrates a perspective view of the disassembled component parts of one potential embodiment of the water pump unclogging device 100 of the present invention, wherein the component parts are displayed next to one another in accordance with the disclosed architecture. More specifically, the water pump unclogging device 100 comprises a threaded, rod-like body 104 for anchoring and selectively pivoting a plurality of circumferentially-spaced steel wires or hooks 126, 136, 146 equipped with hook ends, points or tips 130, 140, 150. The water pump unclogging device 100 further comprises a sleeve 101 with internal threads (not illustrated) that can be threaded over external threads 204 of the rod body 104.

The sleeve 101 of the water pump unclogging device 100 comprises an external gripping surface 102. In one exemplary embodiment, the external gripping surface 102 can be knurled. The sleeve 101 of the water pump unclogging device 100 can be manually threaded inward toward the working hook end 120 (refer to FIGS. 3A and 2A), and manually threaded outward away from the working hook end 120.

Figure 1B:
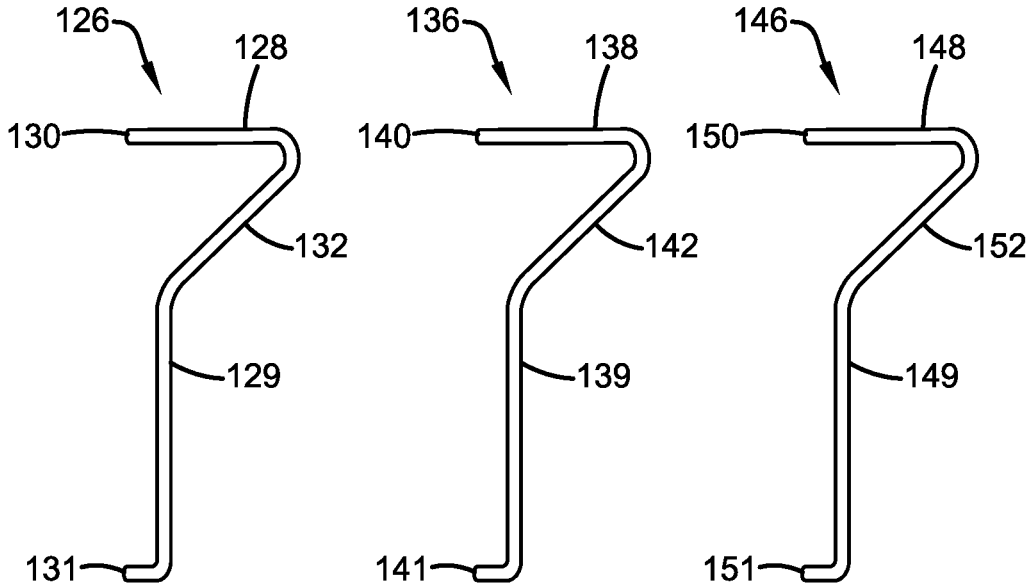
FIG. 1B illustrates enlarged plan views of the retention hooks in one potential embodiment of the water pump unclogging device of the present invention.
Figure 1C:
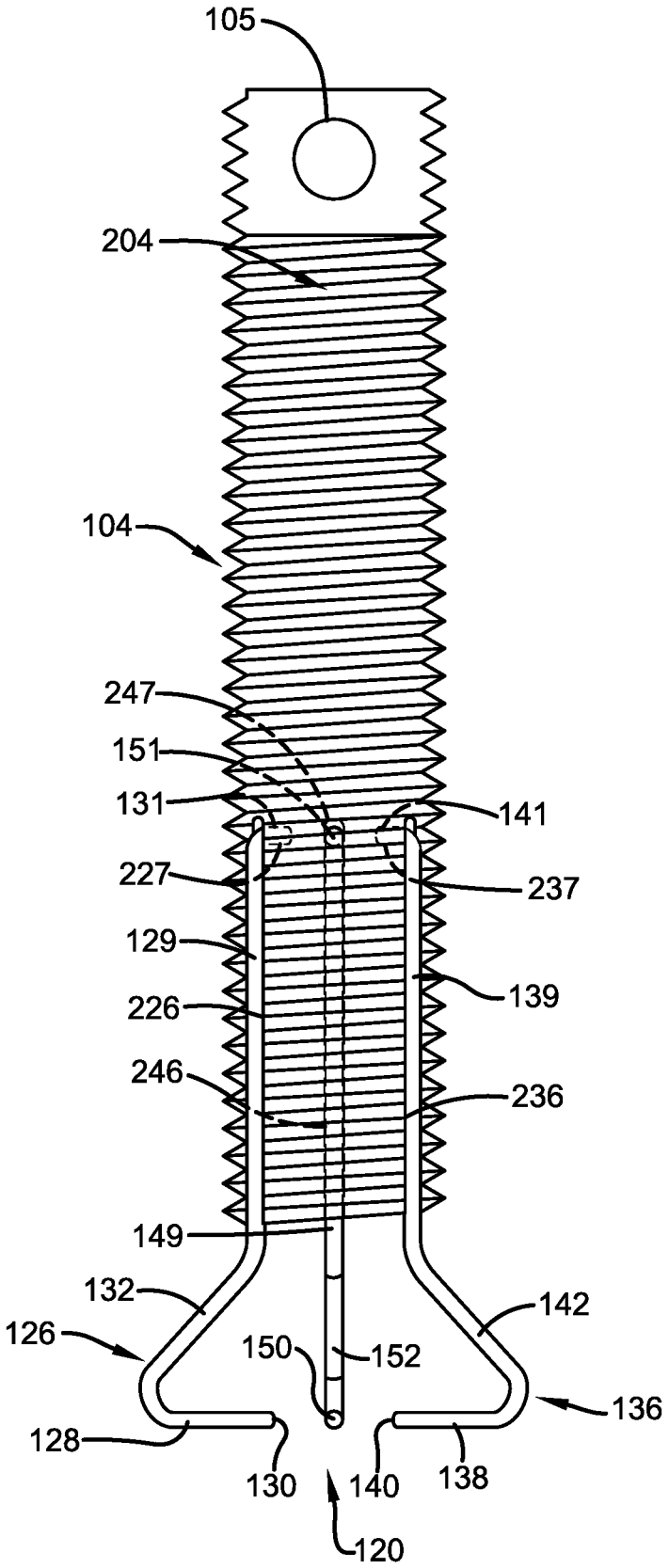
FIG. 1C illustrates an enlarged view of the retention hooks mounted within grooves spaced around a perimeter of a threaded rod in one potential embodiment of the water pump unclogging device of the present invention.

FIG. 1B illustrates enlarged plan views of the hooks 126, 136, 146. Each hook 126, 136, 146 comprises, respectively, a throat section 128, 138, 148; a shank section 129, 139, 149; a point end 130, 140, 150; a pivot end 131, 141, 151; and a bend section 132, 142, 152. Referring now to FIG. 1C, the shank 129, 139, 149 of each hook 126, 136, 146 can be retained and selectively constrained in a recessed channel 226, 236, 246 circumferentially-spaced about rod 104. The pivot end 131, 141, 151 of each hook can be anchored in slots 227, 237, 247. In one exemplary arrangement, hooks 126, 136, 146 are spaced 120 degrees away from one another around the exterior of rod 104. In another exemplary arrangement, the hooks can each include multiple bend sections, multiple throat sections, and multiple point ends (not illustrated). It is to be appreciated that the hooks are selectively replaceable. Replacing the hooks can include changing the steel wire gauge of the hooks to adapt the unclogging device relative to the size of pipe and/or pump and the associated size of the clog.

Figure 2A:
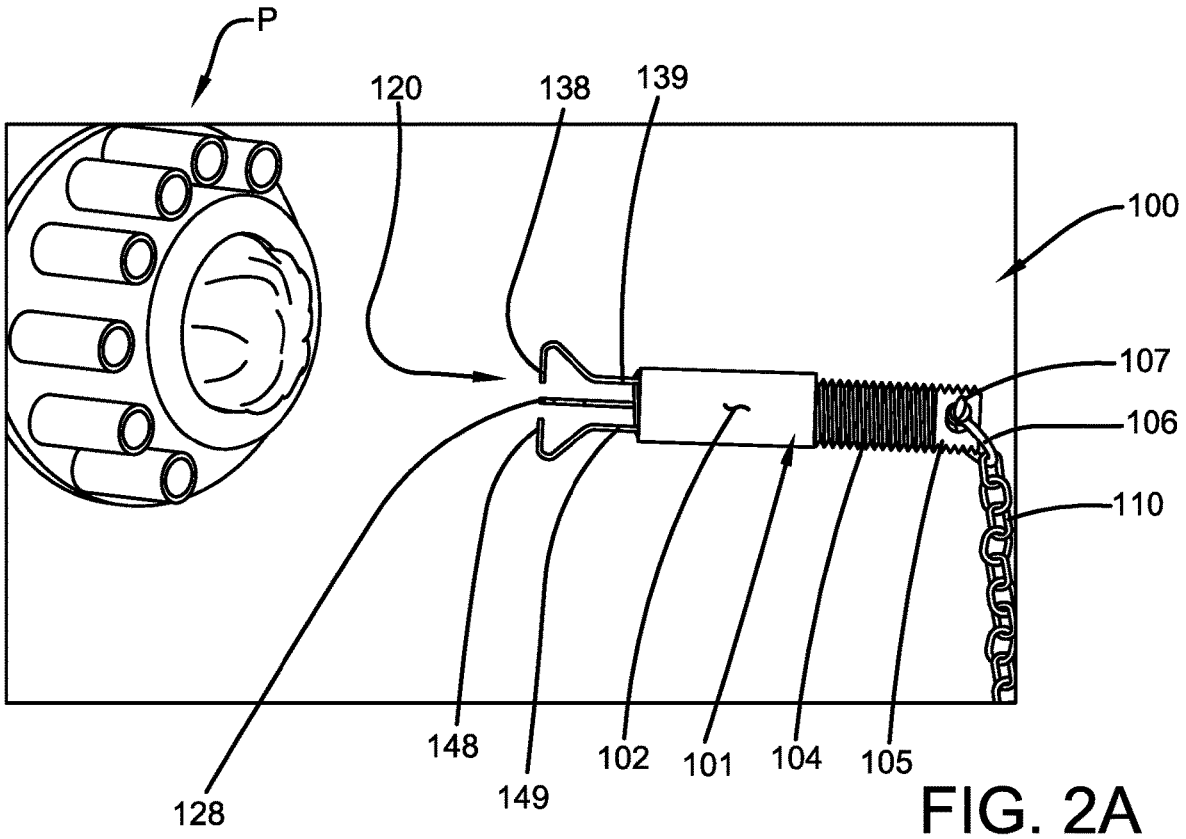
FIG. 2A illustrates a perspective view of one potential embodiment of the assembled water pump unclogging device of the present invention, in a first position for insertion into a water pump into which the water pump unclogging device would be inserted for the purpose of removing rags, cloth materials, debris, or other obstructions, in accordance with the disclosed architecture.
Figure 2B:
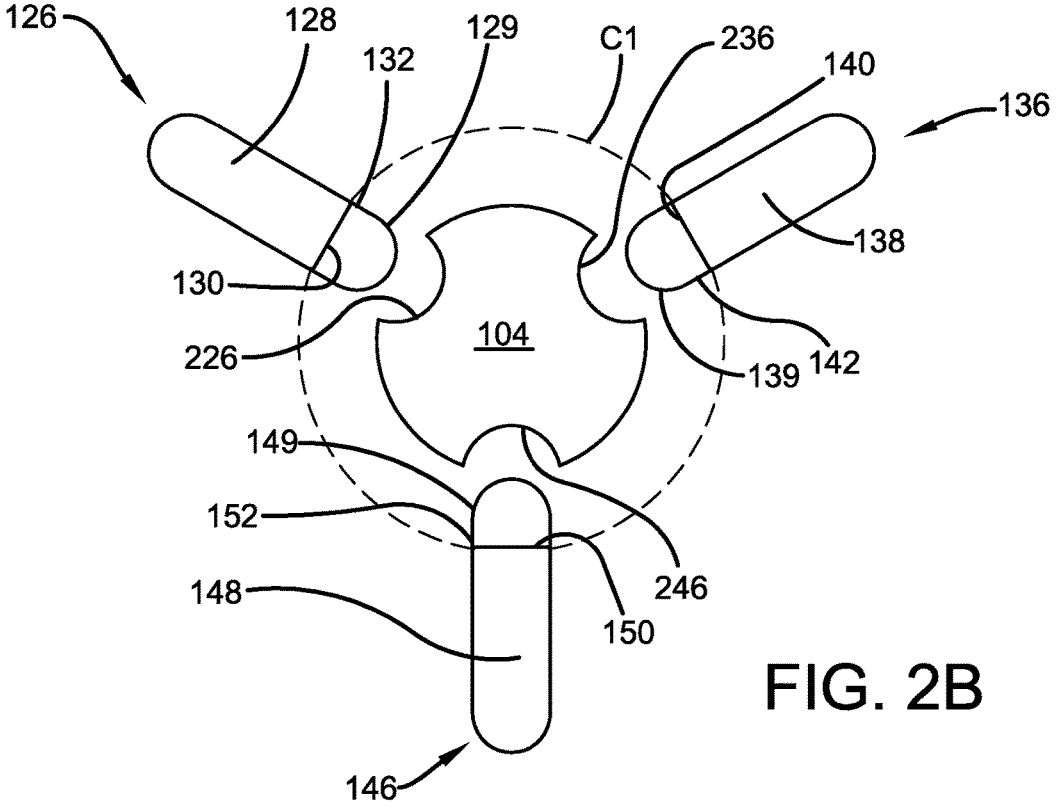
FIG. 2B illustrates an enlarged plan view of the working end of assembled water pump unclogging device in the first position for insertion into the water pump into which the water pump unclogging device would be inserted for the purpose of removing rags, cloth materials, debris, or other obstructions in accordance with the disclosed architecture.
Figure 3A:
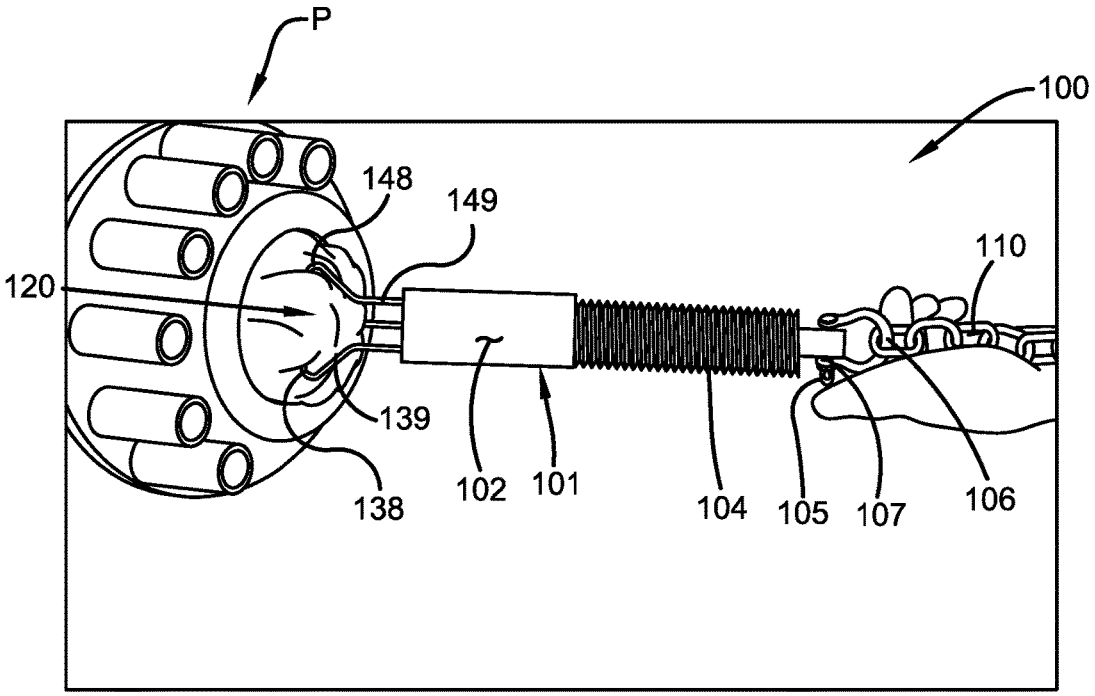
FIG. 3A illustrates a perspective view of one potential embodiment of the assembled water pump unclogging device of the present invention, in a second position after insertion into a water pump for the purpose of grasping and extracting rags, cloth materials, debris, and other obstructions in accordance with the disclosed architecture.
Figure 3B:
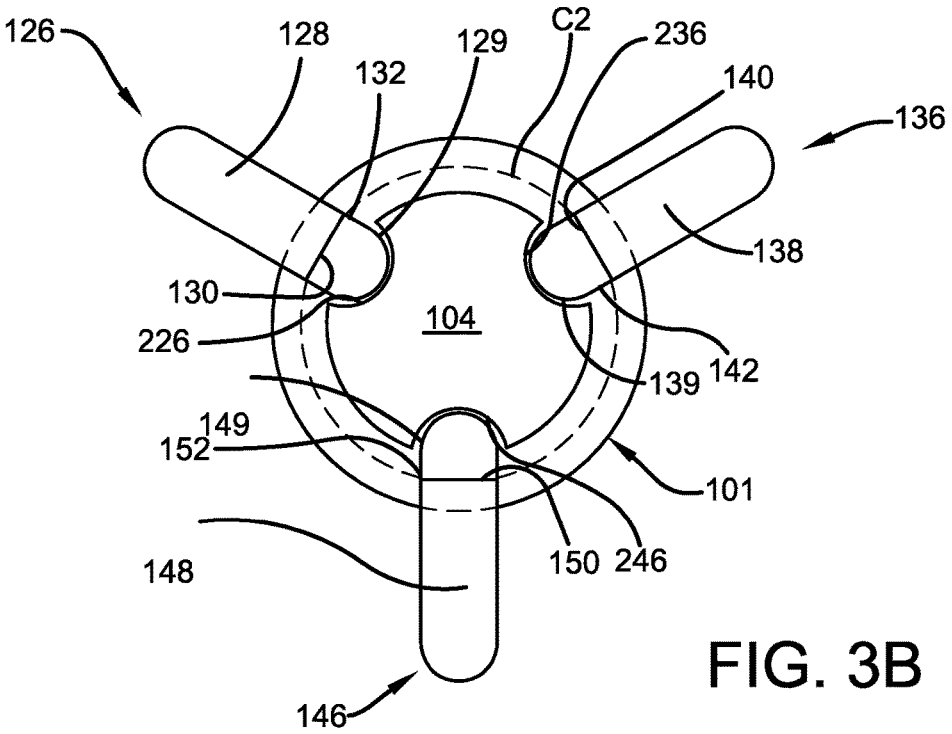
FIG. 3B illustrates an enlarged plan of the working end of the assembled water pump unclogging device in the second position after insertion into a water pump for the purpose of grasping and extracting rags, cloth materials, debris and other obstructions in accordance with the disclosed architecture

The sleeve 101 in a first position, as shown in FIGS. 2A and 2B, is threaded to a location on rod 104 that enables the movement of shanks 129, 139, 149 beyond channels 226, 236, 246 to create a first circumference C1, defined by the hook points 130, 140, 150 in a partially-constrained arrangement (FIG. 2B). In this orientation, the unclogging device 100 can be inserted into a water pump P. After the unclogging device 100 has been inserted into the water pump P and the obstruction has been contacted by the hook points 130, 140, 150, the sleeve 101 can be threaded inward to a second position (refer to FIGS. 3A and 3B) at the working end 120 of the rod 104. In the second position, the shanks 129, 139, 149 are confined within channels 226, 236, 246 by the sleeve 101 in a fully-constrained arrangement (FIG. 3B).

The shanks 129, 139, 149 are prohibited from movement beyond channels 226, 236, 246 whereby the hooks 126, 136, 146 create a second circumference C2 defined by the hook points 130, 140, 150 in a fully-constrained arrangement. It is to be appreciated that the circumferential movement from the first circumference C1 to the relatively smaller second circumference C2 exerts a constricting or retention force to the hook points 130, 140, 150, which is then translated to the obstruction within the water pump P. The retention force grasps the obstruction, thereby enabling the unclogging device to proceed to extraction. The translation of the retention force is facilitated by the configuration of the bend sections 132, 142, 152 which translate the retention forces from the shank sections 129, 139, 149 to the throat sections 128, 138, 148 that are orthogonal to the shank sections. The water pump unclogging device 100 maintains the second circumference C2 when the circumferentially-spaced steel hooks 126, 136, 146 are in the fully constrained arrangement (refer to FIGS. 3A and 3B), thereby maintaining a secure grip of the obstruction during extraction.

The rod body 104 of the water pump unclogging device 100 can include a hole 105 at another end in which a metal pin 107 can be inserted to affix a first metal eye hook 106. Further, the first metal eye hook 106 of the water pump unclogging device 100 can be attached to a metal chain or extension bar 110 which can include a second metal hook 112 affixed by a metal pin 111 to an opposing end of the metal chain 110. It is to be appreciated that the metal hook 112 of the water pump unclogging device affixed to the metal chain or extension bar 110 can be attached to a crane or other mechanical device to permit the water pump unclogging device 100 to be used for power-assisted pulling, unclogging and removal of rags, cloth materials, debris and other obstructions. Further, the water pump unclogging device 100 can be used either as a hand tool or as a power-assisted device for extraction of rags, cloth materials, debris and other obstructions. It is to be appreciated that the water pump unclogging device 100 may be comprised of any suitable shape, material and/or size.

Figure 4:
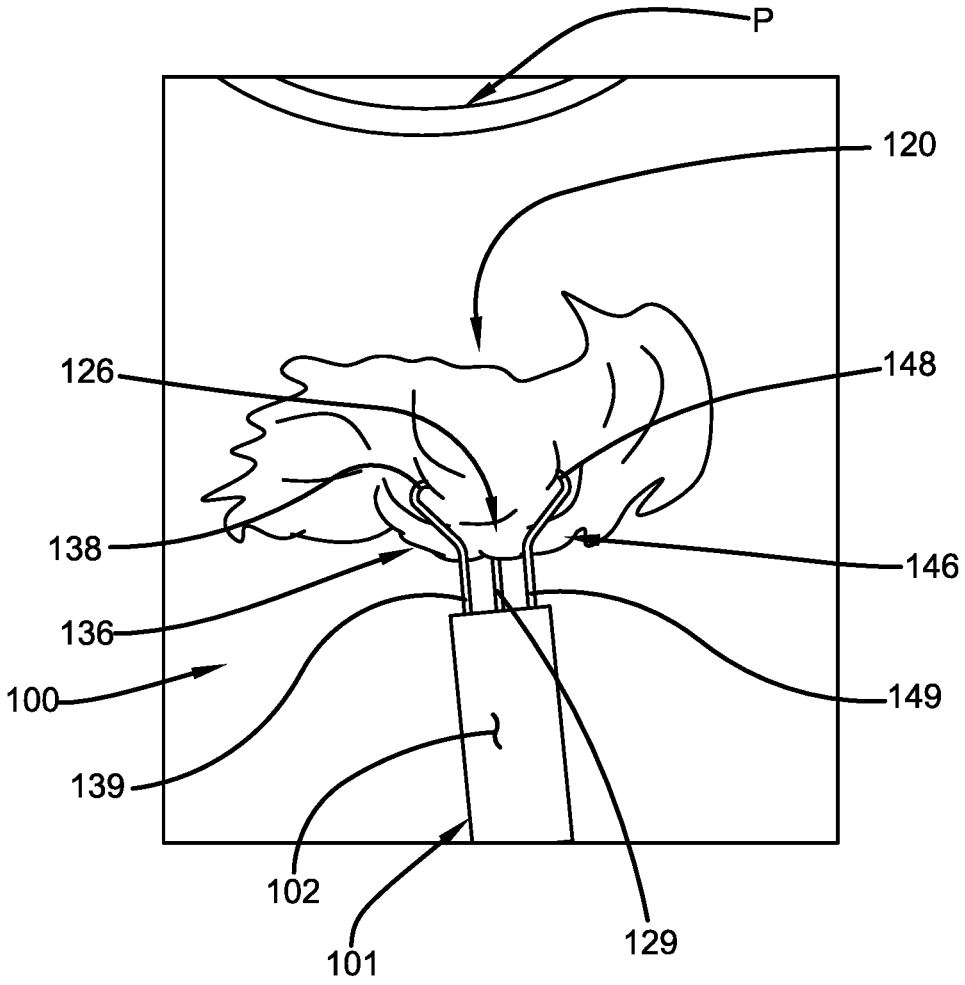
FIG. 4 illustrates a perspective view of one potential embodiment of the assembled water pump unclogging device of the present invention, in the second position, with grasped and extracted rags and other cloth materials removed from the opening of a water pump, in accordance with the disclosed architecture.

FIG. 4 illustrates a perspective view of the assembled water pump unclogging device 100 of the present invention capable of grasping rags, cloth materials and other debris, after extraction, in accordance with the disclosed architecture. The hook ends (not illustrated) of the circumferentially spaced steel hooks 126, 136, 146 of the water pump unclogging device 100 grasp rags, cloth materials and other debris that have been removed from the water pump P. Although not illustrated, it is to be appreciated that reversing the threading of the sleeve, to traverse the sleeve away from the working end of the rod, will un-restrain the hooks and free them from the rod. Once unrestrained, each individual hook can be independently manipulated (i.e. 'backed-out') to free itself from the obstructing material.

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "invention", "device", and "tool", are interchangeable and refer to the water pump unclogging device 100 of the present invention.

Notwithstanding the forgoing, the water pump unclogging device 100 of the present invention can be of any suitable size, configuration and material as is known in the art without affecting the overall concept of the invention, provided that it accomplishes the above-stated objectives. One of ordinary skill in the art will appreciate that the size, configuration and material of the water pump unclogging device 100 as shown in the FIGS. are for illustrative purposes only, and that many other sizes, shapes and materials of the water pump unclogging device 100 are well within the scope of the present disclosure. Although the dimensions of the water pump unclogging device 100 are important design parameters for user convenience, the water pump unclogging device 100 may be of any size or shape/ type that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A pump unclogging device comprising:

an externally threaded rod including a plurality of recessed channels circumferentially spaced about a first end of said rod, each recessed channel comprising a slot extending perpendicularly inward from an enclosed end of the respective recessed channel;

a plurality of hooks, wherein each of said plurality of hooks comprises a pivot end, a shank section, a bend section, a throat section and a point end;

an internally threaded sleeve, wherein the internal threads of said sleeve are sized for mating engagement with said external threads of said rod;

wherein each said pivot end and said shank section of each said hook is insertable into one said recessed channel and each pivot end is anchored within the respective slot;

wherein said sleeve is rotatable from a first position to a second position along said rod;

said first position partially constrains said plurality of hooks about said rod wherein said point ends of said plurality of hooks define a first circumference;

said second position fully constrains said plurality of hooks about said rod within said recessed channels wherein said point ends of said plurality of hooks define a second circumference for grasping obstructing material in the pump; and said second circumference is smaller than said first circumference.

2. The pump unclogging device of claim 1, wherein for each said hook; a portion of said shank section, said bend section, said throat section, and said point end, extends beyond said first end of said rod.

3. The pump unclogging device of claim 2, wherein said throat section of each said hook is generally orthogonal to said shank section.

4. The pump unclogging device of claim 3, wherein said plurality of hooks is two hooks.

5. The pump unclogging device of claim 4, wherein said plurality of hooks are comprised of steel material.

6. The pump unclogging device of claim 3, wherein said plurality of hooks is three hooks.

7. The pump unclogging device of claim 6, wherein said plurality of hooks are comprised of steel material.

8. The pump unclogging device of claim 7, wherein said second circumference defined by said point ends of said hooks is maintained while the grasped obstructing material is extracted from the pump.

9. The pump unclogging device of claim 8, wherein said rod further comprising a hole at a second end for retention of a metal pin for affixing a metal eye hook thereto.

10. A pump unclogging device comprising:

an externally threaded rod including a plurality of recessed channels circumferentially spaced about a first end of said rod, each recessed channel comprising a slot extending perpendicularly inward from an enclosed end of the respective recessed channel;

a plurality of hooks wherein each hook includes a pivot end, a shank section, a bend section, a throat section, and a point end;

an extension component;

said plurality of hooks is three hooks;

an internally threaded sleeve wherein the internal threads of said sleeve are sized for mating engagement with said external threads of said rod;

wherein each said pivot end and said shank section of each said hook is insertable into one said recessed channel and each pivot end is anchored within the respective slot;

wherein said sleeve is rotatable from a first position to a second position along said rod;

said first position partially constrains said plurality of hooks about said rod wherein said point ends of said plurality of hooks define a first circumference;

said second position fully constrains said plurality of hooks about said rod completely within said recessed channels wherein said point ends of said plurality of hooks define a second circumference for grasping obstructing material in the pump;

said second circumference is smaller than said first circumference;

said throat section of each said hook is generally orthogonal to said shank sections; and wherein said rod further comprises an extension attachment component at a second end for connecting the extension component to the rod.

11. The pump unclogging device of claim 10, wherein for each said hook; a portion of said shank section, said bend section, said throat section, and said point end, extends beyond said first end of said rod.

12. The pump unclogging device of claim 11, wherein said plurality of hooks are comprised of steel material.

13. The pump unclogging device of claim 12, wherein said second circumference defined by said point ends of said hooks is maintained while the grasped obstructing material is extracted from the pump.

* * * * *